US006644792B1

(12) United States Patent
Jeanmaire et al.

(10) Patent No.: US 6,644,792 B1
(45) Date of Patent: Nov. 11, 2003

(54) INK DROPLET FORMING APPARATUS AND METHOD FOR USE IN INK JET PRINTER SYSTEM

(75) Inventors: David L. Jeanmaire, Brockport, NY (US); James M. Chwalek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/280,217

(22) Filed: Oct. 25, 2002

(51) Int. Cl.[7] ..... B41J 2/05
(52) U.S. Cl. ..... 347/82
(58) Field of Search ..... 347/73, 74, 77, 347/82

(56) References Cited

U.S. PATENT DOCUMENTS 1,941,001 A 12/1933 Hansell
3,373,437 A 3/1968 Sweet et al.
3,416,153 A 12/1968 Hertz et al.
3,709,432 A 1/1973 Robertson
3,878,519 A 4/1975 Eaton
4,190,844 A 2/1980 Taylor
4,346,387 A 8/1982 Hertz
4,638,382 A 1/1987 Sochor
4,914,522 A 4/1990 Duffield et al.
5,224,843 A 7/1993 van Lintel
6,019,457 A 2/2000 Silverbrook
6,079,821 A 6/2000 Chwalek et al.

*Primary Examiner*—Anh T. N. Vo
(74) *Attorney, Agent, or Firm*—Roger A. Fields

(57) ABSTRACT

According to one aspect of the invention, an ink droplet forming mechanism for use in an ink jet printer system includes an ink discharge nozzle for discharging a printing ink; at least two heating elements activatable individually to heat a printing ink at the nozzle to form an ink droplet; and a controller connected individually to each heating element for activating at least two heating elements so that should one heating element fail at least one other will heat a printing ink at said nozzle to form an ink droplet.

6 Claims, 4 Drawing Sheets

INK DROPLET FORMING APPARATUS AND METHOD FOR USE IN INK JET PRINTER SYSTEM

CROSS-REFERENCE TO RELATED APPLICATION

Reference is made to commonly assigned application Ser. No. 09/751,232, entitled CONTINUOUS INK-JET PRINTING METHOD AND APPARATUS and filed Dec. 28, 2000 in the names of David L. Jeanmaire, et al. which is incorporated herein.

FIELD OF THE INVENTION

This invention relates generally to the field of ink jet printer systems, and in particular to an ink droplet forming mechanism for use in an ink jet printer system.

BACKGROUND OF THE INVENTION

It is not uncommon for an ink droplet forming mechanism in a continuous ink jet printer system to include a printhead, a plurality of ink supplies in pressurized fluid communication with respective ink discharge nozzles on the printhead, and a controller for ink heaters associated with each ink discharge nozzle. When the controller activates or energizes a heater, a resistive heating element in the heater is heated to in turn heat an ink stream flowing from the associated nozzle. The heated ink then releases an ink droplet, which is used for printing an image pixel on a receiver medium such as a paper sheet.

Since there is usually only one resistive heater element per ink discharge nozzle, failure of the heater element disables the ink droplet forming mechanism. In this connection, however, prior art U.S. Pat. No. 6,019,457 issued Feb. 1, 2000, generally teaches the use of a main resistive heating element and a redundant resistive heater element per ink discharge nozzle in a drop-on-demand bubble ink jet printer. The redundant heating element appears to be activated only when the main heating element fails. This requires, as stated in the patent, a sensing circuit to sense a failure of the main heating element and then activate the redundant heating element.

SUMMARY OF THE INVENTION

According to one aspect of the invention, an ink droplet forming mechanism for use in an ink jet printer system comprises:

an ink discharge nozzle for discharging a printing ink;

at least two heating elements activatable individually to heat a printing ink at the nozzle to form an ink droplet; and a controller connected individually to each heating element for activating at least two heating elements so that should one heating element fail at least one other will heat a printing ink at said nozzle to form an ink droplet.

According to another aspect of the invention, an ink droplet forming method in an ink jet printer system comprises:

discharging a printing ink from an ink discharge nozzle;

including at least two heating elements separately activatable simultaneously to heat a printing ink at the nozzle to form an ink droplet; and separately activating at least two heating elements to heat a printing ink at the nozzle to form an ink droplet, but should one heating element fail activating at least one other, so that at least one heating element will heat a printing ink at said nozzle to form an ink droplet.

DETAILED DESCRIPTION OF THE INVENTION

Commonly assigned prior art U.S. Pat. No. 6,079,821, issued Jun. 27, 2000, discloses a continuous ink jet printer system including an image source such as a scanner or computer which provides raster image data, outline image data in the form of page description language, or other forms of digital image data. This image data is converted to half-toned bitmap image data by an image processing unit which also stores the image data in a memory. A plurality of heater control circuits read data from the memory and apply time-varying electrical pulses to a set of nozzle heaters that are part of a printhead. These pulses are applied at an appropriate time, and to the appropriate nozzle heater, so that ink droplets will be formed from a continuous ink jet stream to create spots on a recording medium moving relative to the printhead.

The Cross-referenced Application (FIGS. 1, 2A–2F, 3)

Figure 1:
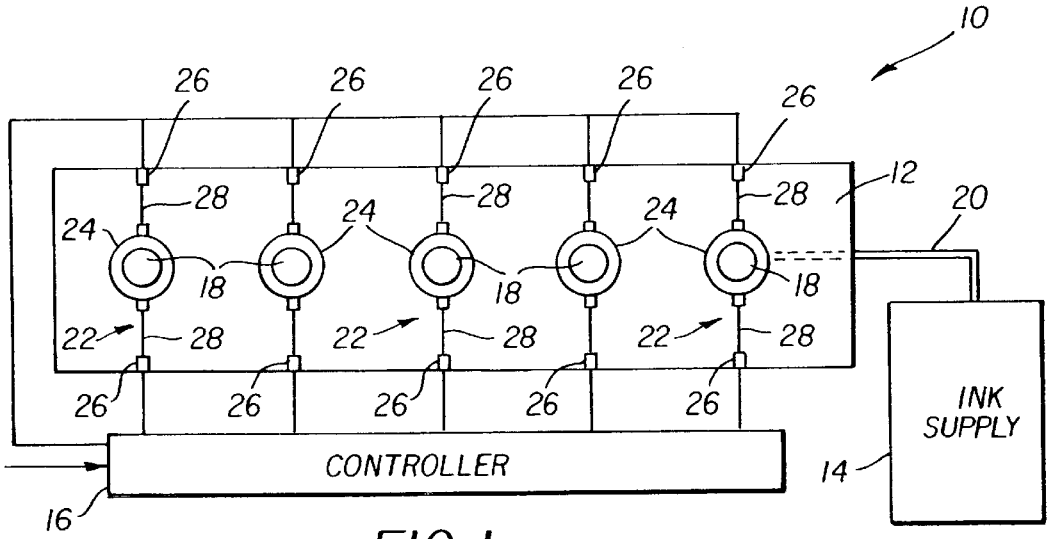
FIG. 1 depicts in a schematic block form an ink droplet forming mechanism for use in a continuous ink jet printer system as disclosed in the cross-referenced application.

FIG. 1 shows an ink droplet forming mechanism 10 which can be used in a continuous ink jet printer system such as the one disclosed in incorporated U.S. Pat. No. 6,079,821.

The ink droplet forming mechanism 10 shown in FIG. 1 has a printhead 12, at least one ink supply 14 and a controller 16. It is depicted in a schematic block form, which is not to scale simply for the sake of clarity. The controller 16 may, for example, be a known type logic control device or suitably programmed microprocessor as in the incorporated patent.

The printhead 12 can be formed from a semiconductor material, e.g. silicon, using known semiconductor fabrication techniques, e.g. CMOS circuit fabrication techniques or micro-electro mechanical structure (MEMS) fabrication techniques.

At least one ink discharge nozzle or outlet 18 is included on the printhead 12. The ink discharge nozzle 18 is in pressurized fluid-receiving communication with the ink supply 14 via an ink passage 20. Of course, as shown in FIG. 1, the printhead 12 may include a plurality of ink supplies and associated ink passages, and also the same number of ink discharge nozzles 18, in order to provide multi-color printing using three or more ink colors such as yellow, cyan and magenta. On the other hand, black and white or single-color printing may be accomplished using a single ink supply 14 and associated ink passage 20, and also a single nozzle 18.

Respective ink heaters 22 are at least partially formed or positioned on the printhead 12 around the ink discharge nozzles 18 as shown in FIG. 1. Although each heater 22 may be disposed radially away from an edge of a nozzle 18, preferably it is disposed close to the nozzle and concentric about the nozzle. As shown in FIG. 1, each heater 22 is formed in a substantially circular or ring shape and has an annular resistive heating element 24 electrically connected to a conductive contact pad 26 via a conductor 28. Each conductor 28 and contact pad 26 in FIG. 1 are at least partially formed or positioned on the printhead 12, and they provide an electrical connection between the controller 16 and one of the heaters 22.

Figure 2A:
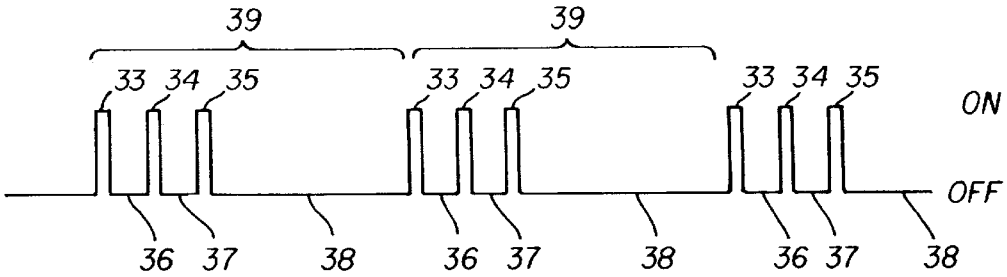
FIGS. 2A through 2F are timing diagrams illustrating activation or energization of a heater, in a printhead included in the ink droplet forming mechanism, to heat a single resistive heating element in the heater in order to create ink droplets as disclosed in the cross-referenced application.
Figure 2B:
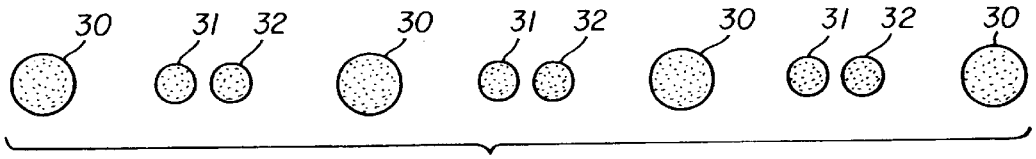

FIG. 2A depicts an example of an electrical heater-activation pulse-waveform which is provided by the controller 16 separately to each heater 22 in order to activate or energize the heater successive times (via successive activation pulses) by heating its resistive heating element 24. FIG. 2B depicts successive ink droplets 30, 31 and 32 resulting from successive activations of a single heater 22 and a substantially constant "jetting", i.e. a substantially constant flow rate, of a printing ink from the nozzle 18 on that heater. Generally speaking, as indicated in FIGS. 2A and 2B, a high frequency of activation of a heater 22 results in a small volume printing droplet, e.g. 31 or 32, and a low frequency of activation of the heater results in a large volume non-printing droplet, e.g. 30.

Assuming there are to be formed multiple ink droplets per image pixel as shown in FIGS. 2A and 2B, a cycle or total time 39 associated with the printing of a single pixel consists of at least one short time sub-interval or delay time, e.g. 36 or 37, for creating a small volume printing droplet 31 or 32, and a long time sub-interval or delay time 38 for creating a large volume non-printing droplet 30. In FIGS. 2A and 2B, there are shown two successive delay times 36 and 37 for creating respective small volume printing droplets 31 and 32 during a cycle or total time 39 for printing a single pixel. However, this is shown only for simplicity of illustration. It should be understood that a greater or lesser number of delay times is possible for creating a corresponding number of small volume printing droplets.

In FIGS. 2A and 2B, each successive cycle or total time 39 associated with the printing of successive pixels is the same. Moreover, the delay times 36 and 37 during a single cycle or total printing time 39 for the printing of a single pixel are identical, and the delay time 38 during the same cycle printing is longer than the sum of the delay times 36 and 37.

When printing a single pixel during a cycle or total time 39 in FIGS. 2A and 2B, a pulse order in the waveform can be as follows. First, a small volume printing droplet 31 is created as a consequence of an activation pulse 34 in the waveform which activates or energizes a heater 22 by heating its resistive heating element 24. Then, a small volume printing droplet 32 is created as a consequence of an activation pulse 35 in the waveform which activates or energizes the same heater by heating its resistive heating element. And finally, a large volume non-printing droplet 30 is created as a consequence of an activation pulse 33 in the waveform which activates or energizes the same heater by heating its resistive heating element. Since the delay time 36 from an activation pulse 33 to an activation pulse 34 is the same as the delay time 37 from an activation pulse 34 to an activation pulse 35 during a single cycle or total time 39 in FIG. 2*a*, the small volume printing droplets 36 and 37 created in that cycle have the same volume. Since the delay time 38 from an activation pulse 35 to an activation pulse 33 is longer than the similar delay times 36 and 37 during the same cycle, the large volume non-printing droplet 30 created in that cycle has to have a larger volume than the small volume printing droplets 36 and 37 created in that cycle. In other words, it is ultimately the particular delay time 36, 37 or 38 for the activation pulse 34, 35 or 33 that determines the particular volume of an ink droplet 31, 32 or 30.

The duration of the activation pulse 33 for a large volume non-printing droplet 30 is typically from 0.1 to 10 microseconds, and more preferentially is from 0.5 to 1.5 microseconds. The duration of the activation pulses 34 and 35 for small volume printing droplets 31 and 32 is typically 1 to 100 microseconds, and more preferentially is from 3 to 6 microseconds. All of the activation pulses 33, 34 and 35 in FIG. 2A have the same amplitude (although that is not required).

Figure 2C:
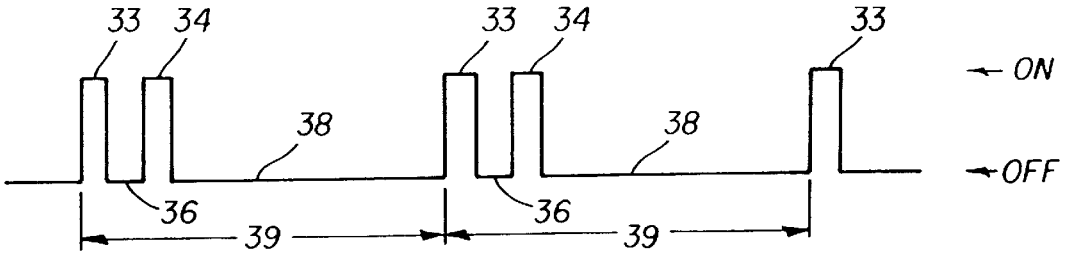
Figure 2D:
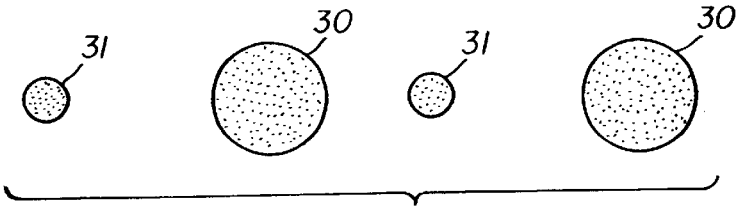
Figure 2E:
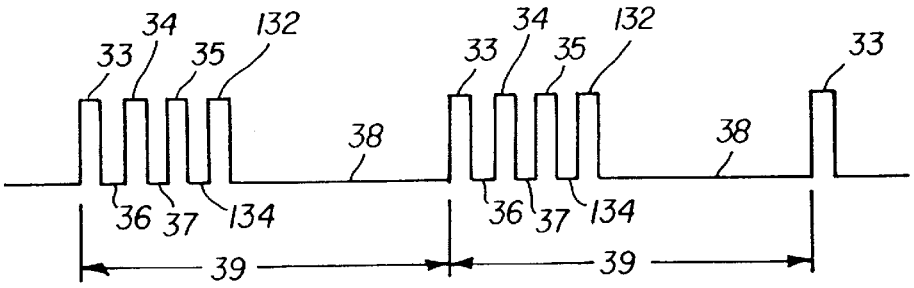
Figure 2F:
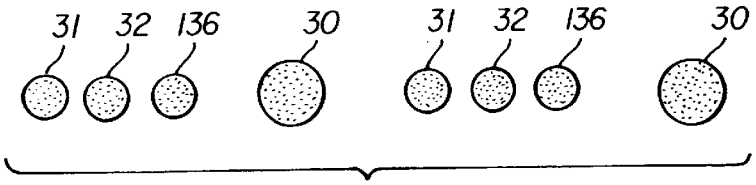

FIGS. 2A and 2B when compared with FIGS. 2C–2F indicate that a large volume non-printing droplet 30 will vary in volume depending on the number of preceding small volume printing droplets created during a cycle or total time 39 for printing a single pixel. For example, in FIG. 2D, only one small volume printing droplet 31 is created before creating a large volume non-printing droplet 30 in a single cycle or total time 39 in FIG. 2C. As such, the volume of a large volume non-printing droplet 30 in FIG. 2D is greater than the volume of a large volume non-printing droplet 30 in FIG. 2B. The reason for this, in essence, is that the delay time 38 in FIG. 2C is greater than the delay time 38 in FIG. 2A. In FIGS. 2E and 2F, three small volume printing droplets 31, 32 and 136 are created in accordance with the delay times 36, 37 and 134 (delay time 134 in FIG. 2E is for an activation pulse 132). As such, the volume of a large volume non-printing droplet 30 in FIG. 2F is less than the volume of a large volume non-printing droplet 30 in FIG. 2D. The reason for this, in essence, is that the delay time 38 in FIG. 2E is less than the delay time 38 in FIG. 2C. The volume of a large volume non-printing droplet 30 in FIG. 2F is greater than the volume of small volume printing droplets 31, 32, 136 in FIG. 2F, preferably by at least a factor of four (4).

Preferably, small volume printing droplets 31, 32 and 136 impinge on a print or receiver medium (not shown) such as a paper sheet on a rotating print drum, and large volume non-printing droplets 30 are collected in an ink gutter (not shown) in order to be recycled back to the ink supply 14. However, the opposite is possible, i.e. large volume droplets 30 can serve as printing droplets that impinge on the receiver medium, and small volume droplets 31, 32 and 136 can serve as non-printing droplets which are collected in the ink gutter to be recycled. All that is required to effect the change, essentially, is to re-position the ink gutter so that it collects small volume droplets 31, 32 and 136 instead of collecting large volume droplets 30. Using large volume droplets 30 as printing droplets allows for varying-volume printing droplets as can be seen by comparing FIGS. 2B, 2D and 2F.

Figure 3:
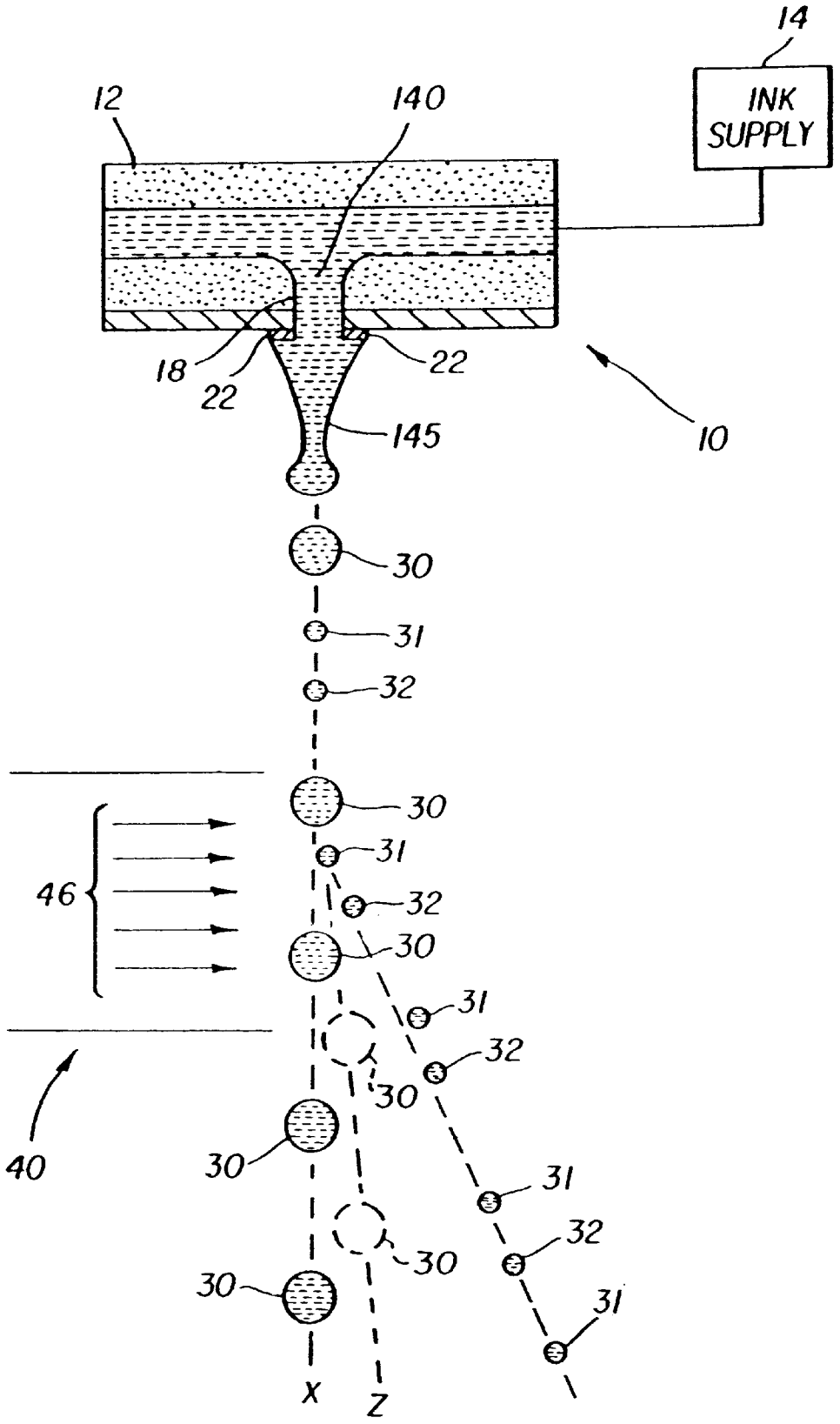
FIG. 3 is a cross-section view of the printhead and the ink droplets as disclosed in the cross-referenced application, illustrating separation of the ink droplets into small volume printing droplets and large volume non-printing droplets along respective paths.

FIG. 3 shows a pressurized ink 140, originating at the ink supply 14, and flowing from a nozzle 18 at a heater 22 on the printhead 12, to form a filament or stream of printing ink 145 at the nozzle. As previously explained, small volume printing droplets 31 and 32 and a large volume non-printing droplet 30 can be created when the heater 22 is activated or energized successive times during a cycle or total time 39 for printing a single pixel as in FIGS. 2A and 2B, etc.

In FIG. 3, large volume non-printing droplets 30 and small volume printing droplets 31 and 32 when separated from the filament or stream of printing ink 145 at a nozzle 22 initially move along a droplet path X leading to the ink gutter. A droplet deflector 40 uses a pressurized gas to apply a gas force 46, in a direction transverse to the droplet path X, to ink droplets 30, 31 and 32 as they travel along the droplet path. The gas force 46 interacts with ink droplets 30, 31 and 32 along the droplet path X, causing ink droplets 31 and 32 to alter course. Since ink droplets 30 have different volumes than ink droplets 31 and 32, the gas force 46 causes small volume printing droplets 31 and 32 to separate from large volume non-printing droplets 30. Small volume printing droplets 31 and 32 diverge from droplet path X and into a droplet or print path Y leading to the receiver medium. Although large volume droplets 30 can be slightly affected by the gas force 46, they either remain in the droplet path X or deviate slightly from that path into a close path Z (close to the droplet path X) which, like the droplet path X, leads to the ink gutter. Thus, the large volume non-printing droplets are not moved out of a collecting range of the ink gutter.

Figure 4:
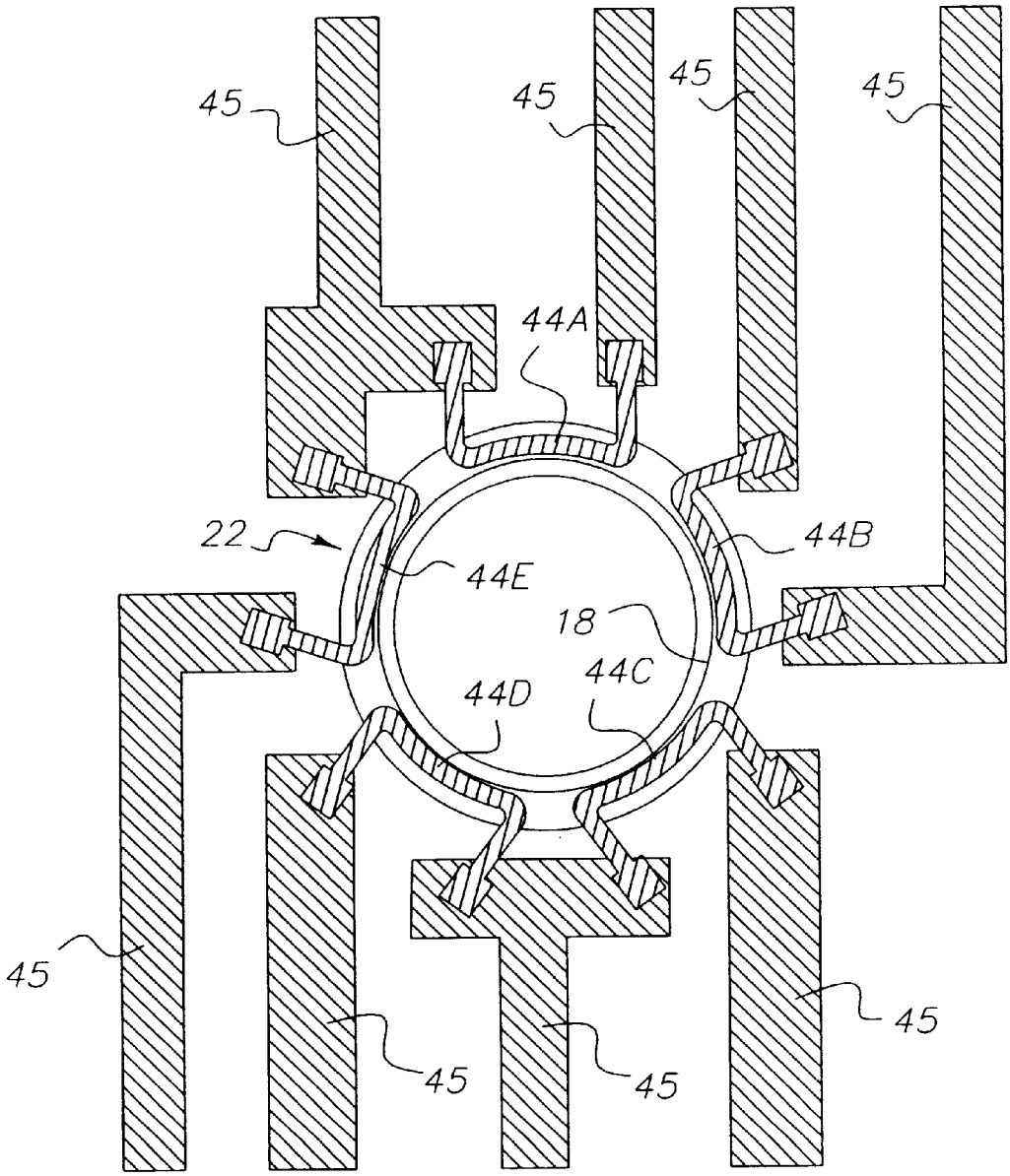
FIG. 4 is plan view of an improvement to the heater, by which at least two resistive heating elements in the heater are activatable individually so that should one fail the other is still used, according to a preferred embodiment of the invention.

Preferred Embodiment (FIG. 4)

According to the invention, each heater 22 positioned around an ink discharge nozzle 18, instead of having only one annular resistive heating element 24 as in FIG. 1, has at least two resistive heating elements disposed about the nozzle.

In FIG. 4, there is shown a circular arrangement of separate resistive heating elements 44A, 44B, 44C, 44D and 44E disposed in evenly spaced relation about the nozzle 18 to substantially define a segmented circle around the nozzle. The heating elements 44A, 44B, 44C, 44D and 44E are electrically connected via respective conductors 45 as shown in FIG. 4 to the controller 16.

In operation, all of the resistive heating elements 44A, 44B, 44C, 44D and 44E in a heater 22 are activated individually via the controller 16 to each (collectively or separately) serve to create small volume printing droplets, e.g. 31 and 32, and a large volume non-printing droplet 30 during a cycle or total time 39 for a single pixel as in FIGS. 2A and 2B. Thus, should one heating element fail, the others can continue to serve as stated.

The controller 16 activates all of the resistive heating elements 44A, 44B, 44C, 44D and 44E to the same operating temperature, e.g. 20—less than 100 degrees centigrade, and preferably 40–60 degrees centigrade 50. This is below the boiling point of a filament or stream of working ink 145 at a nozzle 22. See FIG. 3.

If at least one, but not all, of the resistive heating elements 44A, 44B, 44C, 44D and 44E fail when the controller 16 is attempting to activate them individually, then those resistive heating element that are actually activated may be asymmetrical about a nozzle 22. In spite of this, the ink droplets 30, 31 and 32 will substantially adhere initially to the droplet path X as shown in FIG. 3 so that there is no negative impact.

While the description of the invention includes many details and specificities, it is to be understood that these have been included for purposes of explanation only, and are not to be interpreted as limitations of the invention. Many modifications to the description can be made without departing from the spirit and scope of the invention, as is intended to be encompassed by the following claims and their legal equivalents.

PARTS LIST

10. ink droplet forming mechanism
12. printhead
14. inksupply
16. controller
18. ink discharge nozzle
20. ink passage
22. heater
24. annular resistive heating element
26. conductive contact pad
28. conductor
30. large volume non-printing ink droplet
31. small volume printing droplet
32. small volume printing droplet
33. activation pulse after 38
34. activation pulse after 36
35. activation pulse after 37
36. delay time
37. delay time
38. delay time
39. cycle or total time associated with the printing of a single pixel
40. droplet deflector
44A. resistive heating element
44B. resistive heating element
44C. resistive heating element
44D. resistive heating element
44E. resistive heating element
45. conductors
46. gas force
132. activation pulse after 134
134. delay time
136. small volume printing droplet
140. pressurized ink
145. filament or volume of printing ink
X. droplet path
Y. droplet or print path
Z. close path

What is claimed is:

1. An ink droplet forming mechanism for use in a continuous ink jet printer system, comprising:

an ink discharge nozzle;

a circular arrangement of heating elements positioned in evenly spaced relation around said nozzle, which are activatable individually to heat an ink stream flowing from said nozzle to form an ink droplet; and a controller connected via respective connectors to said heating elements to activate all of said heating elements simultaneously and a number of times to heat the ink stream at said nozzle to form successive ink droplets, and which can interpose different delay times between successive activations of said heating elements to make the ink droplets have different volumes, but should one heating element fail at least one other will heat the ink stream at said nozzle to form the ink droplet.

2. An ink droplet forming mechanism as recited in claim 1, wherein a separator separates the ink drops according to the different volumes.

3. An ink droplet forming mechanism as recited in claim 2, wherein said separator separates an ink droplet having one volume into a printing path and separates another ink droplet having a different volume into a non-printing recycle path.

4. An ink droplet forming mechanism as recited in claim 1, wherein said controller activates said heating elements to a temperature that is below a boiling point of the ink stream at said nozzle.

5. An ink droplet forming mechanism as recited in claim 4, wherein the temperature less than 100 degrees centigrade.

6. An ink droplet forming method in a continuous ink jet printer system, comprising:

flowing an ink stream from an ink discharge nozzle:

including a circular arrangement of heating elements positioned in evenly spaced relation around the nozzle, which are activatable individually to heat the ink stream flowing from the nozzle to form an ink droplet; and separately activating all of the heating elements simultaneously and a number of times to heat the ink stream at the nozzle to form successive ink droplets, and interposing different delay times between successive activations of the heating elements to make the ink droplets have different volumes, but should one heating element fail activating at least one other, so that at least one heating element will heat the ink stream at the nozzle to form the ink droplet.

* * * * *